United States Patent [19]

Fletcher et al.

[11] 4,128,422

[45] Dec. 5, 1978

[54] CYCLOPROPENONE VESICULAR IMAGING COMPOSITION, ELEMENT AND PROCESS

[75] Inventors: George L. Fletcher, Pittsford; Donald H. Wadsworth; Jean E. Jones, both of Rochester, all of N.Y.

[73] Assignee: Eastman Kodak Company, Rochester, N.Y.

[21] Appl. No.: 739,774

[22] Filed: Nov. 8, 1976

[51] Int. Cl.[2] ..... G03C 5/24; G03C 1/68; G03C 1/00

[52] U.S. Cl. ..... 96/48 HD; 96/88; 96/115 R

[58] Field of Search ..... 96/88, 115 R, 48 HD; 260/586 R

[56] References Cited

U.S. PATENT DOCUMENTS

| | | | |
|---|---|---|---|
| 1,990,925 | 2/1935 | Bennett | 96/36.3 |
| 3,091,532 | 5/1963 | Michaelsen | 96/48 HD |
| 3,355,295 | 11/1967 | Priest | 96/91 |
| 3,657,348 | 4/1972 | Tobey | 260/586 R |
| 3,782,933 | 1/1974 | De Boer | 96/115 R |

*Primary Examiner*—Won H. Louie, Jr.
*Attorney, Agent, or Firm*—Dana M. Schmidt

[57] ABSTRACT

A photographic vesicular imaging composition, element and process are provided using a binder having a suitable gas impermeability, a cyclopropenone vesiculating agent, and optionally a spectral sensitizing compound.

15 Claims, 2 Drawing Figures

CYCLOPROPENONE VESICULAR IMAGING COMPOSITION, ELEMENT AND PROCESS

BACKGROUND OF THE INVENTION (1) Field of the Invention

The invention relates to a photographic vesicular imaging composition, element and process. In particular, it concerns such an imaging composition and element containing radiation-sensitive vesiculating agents which imagewise decompose to form microscopic light-scattering vesicles of gas, usually within an appropriate binder. A spectral sensitizer can be used to extend the range of responsiveness.

(2) State of the Prior Art

Vesicular films are of considerable importance in information storage and retrieval, such as by microfilming, due to the facts that vesicular images have very high resulution and are extremely stable in ambient light and normal use temperatures. One of the most common classes of vesiculating agents is diazonium salts which, upon exposure to activating radiation, release nitrogen gas. By an appropriate selection of the binder, the gas is retained within the element until development by heat causes expansion of the gas into light-scattering vesicles. Typical examples are shown in U.S. Pat. Nos. 3,032,414 and 3,355,295 wherein it is noted that the binder should have a "permeability constant", which is in reality an impermeability constant, of between about $1 \times 10^{-11}$ and $1 \times 10^{-15}$ measured as the number of cubic centimeters of gas transmitted by 1 sq. cm. of the binder during 1 second at 30° C. when the pressure gradient is 1 centimeter of Hg per cm of the thickness of the binder layer. Typical of patents disclosing vesiculating elements of this type are U.S. Pat. Nos. 2,699,392; 2,703,756; 2,923,703; 3,032,414; 3,208,850; 3,383,213; 3,620,743; and 3,622,335; and British Pat. No. 402,737 filed Mar. 4, 1932.

One of the more conspicuous problems of vesicular imaging has been the lack of a system which permits spectral sensitization of the vesiculating agent. Such lack is particularly noteworthy at a time when photographic silver halide materials have well-developed techniques for spectral sensitization, and even diazo-coupler dye materials are being spectrally sensitized as discussed hereafter. The result of such a lack is, of course, a limitation of the spectral response of the vesiculating element to that of the particular vesiculating agent used. The sensitivity of such agents is generally in the ultraviolet or near UV portions of the spectrum. UV sources are difficult to obtain, and furthermore interposition of any material which has a filtering effect on UV light reduces the sensitivity of such vesiculating agents to the point of rendering them less desirable for practical purposes. A filtering effect can result from the preparation of vesicular prints from negatives coated on polyethylene terephthalate film base due to the intensive absorption of light at certain short wavelengths by this film base material.

Diazonium compounds have been rendered photolytically responsive to radiation of wavelengths longer than their inherent sensitivity. However, in most such cases, this has been limited to solutions only, a process not having any practical use. Also diazo compounds are thermally unstable at elevated temperatures, which limits the temperature range available for film drying and processing.

Azides and bisazides have been spectrally sensitized by aromatic nitro derivatives, such as nitropyrenes, albeit not in a vesiculating imaging element, as described in F. Lewis and W. Saunders, *J. of Amer. Chem. Soc.*, Vol. 90, page 7033, December 1968; and T. Tsunoda et al, *Photog. Sci. and Eng.*, Vol. 17, No. 4, page 390 (July/August 1973).

A clear and continuing need has existed for a vesicular imaging composition and element that will permit improved spectral sensitization. None of the described patents or other references offer a suitable answer to this need.

Types of vesiculating agents other than those producing $N_2$ have been noted in the art, including carbon monoxide releasing elements, ferric ammonium citrate, and even polyketones which apparently produce vaporizable monomers, Kosar, *Light-Sensitive Systems*, page 278 (1965); and U.S. Pat. No. 3,091,532. These, however, have not been disclosed as being spectrally sensitizable and have not used cyclopropenones specifically. Other examples of carbon monoxide releasing agents are disclosed in U.S. Pat. Nos. 1,944,293; 1,990,925; 1,976,302; and 1,919,194. Patents relating to cyclopropenones per se and methods of making them for use other than as vesiculating agents include U.S. Pat. Nos. 3,657,348; 3,782,938; and 3,787,500.

RELATED APPLICATIONS

In commonly owned U.S. applications Ser. No. 678,805 and 688,664 filed Apr. 21, 1976 and May 21, 1976, entitled "Sensitizers for Photopolymer Compositions," and "Sensitizers for Photocrosslinkable Polymers" respectively, by J. A. VanAllan et al and by D. P. Specht et al, respectively, a class of coumarin dyes and merocyanine dyes is described that is useful for spectrally sensitizing unsaturated light-sensitive materials such as photocrosslinkable polymers.

OBJECTS OF THE INVENTION

It is an object of the invention to provide a vesicular imaging composition, element and process of use, wherein the composition and element are capable of being spectrally sensitized beyond the inherent sensitivity of the vesiculating agent.

A related object of the invention is to provide such a composition, element and process wherein enhanced reprint contrast can be achieved.

Another object of the invention is to provide a vesiculating agent that is thermally stable over all useful temperature ranges.

A further object of the invention is to provide such a composition, element and process which involve non-corrosive ingredients only.

Other objects and advantages will become apparent upon reference to the following Summary and detailed Description of the Preferred Embodiments when read in light of the attached drawing.

SUMMARY OF THE INVENTION

The invention concerns an improved vesicular imaging composition, element and process utilizing a new class of vesiculating agents that can be spectrally sensitized.

More specifically, it has been found that spectrally sensitized, vesicular imaging can be achieved by an improved vesicular imaging composition and element comprising: (I) a polymeric binder having sufficient gas impermeability as to provide a latent image stability period for CO that is substantially greater than about one minute when ascertained for an element having a dried binder thickness of between about 10 and about 15 microns; and (II) admixed with said binder, a radiation-decomposable vesiculating agent capable of generating a gas upon imagewise exposure, wherein that vesiculating agent is a cyclopropenone having a $\lambda_{max}$ in ethanol no greater than about 400 nm in the spectral range of about 250 to about 650 nm.

With such vesiculating agents, increased spectral sensitivity can be achieved by the incorporation of a spectral sensitizing compound having a $\lambda_{max}$ in methanol which is less than about 450 nm.

The process of the invention comprises the steps of imagewise exposing the aforesaid element to activating radiation to provide a developable latent image in the element, and developing the resulting image by heating the element to a temperature and for a time sufficient to force CO bubbles formed by the photodecomposition of the agent to expand to form a visible image.

DESCRIPTION OF THE PREFERRED EMBODIMENTS

Figure 1:
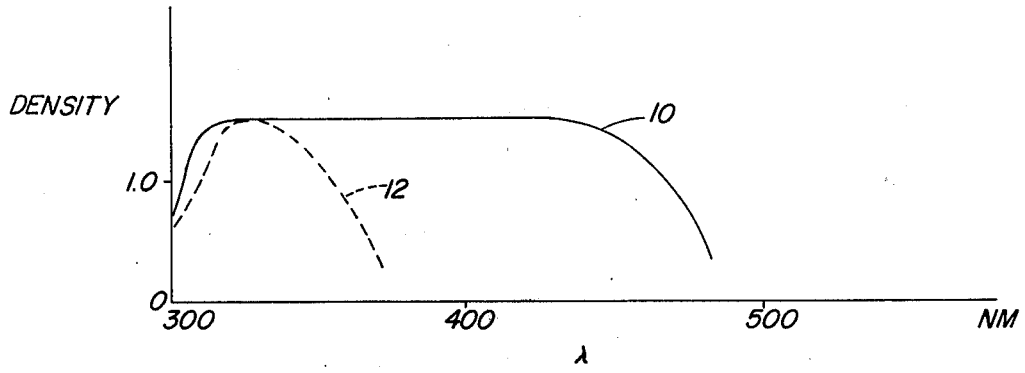
FIGS. 1 and 2 are graphs showing the increased spectral sensitivity that can be achieved by the vesiculating agents of the invention, when combined with active spectral sensitizers.

The invention concerns improved vesicular imaging compositions and imaging elements coated in a film format such as on a suitable support. However, it will be appreciated that the invention also includes any imaging element utilizing the improved compositions hereinafter described. For example, certain polymeric binders by reason of their self-sustaining nature may render the need for a support unnecessary.

Thus, the preferred element of the present invention comprises a support, if used, and coated on at least one surface of the support, a layer comprising a suitable binder and a cyclopropenone vesiculating agent. Any suitable photographic support can be used in the practice of this invention. Typical supports include transparent supports, such as film supports and glass supports as well as opaque supports, such as metal and photographic paper supports. The support can be either rigid or flexible. The most common photographic supports for most applications are paper or film supports, such as poly(ethylene terephthalate) film. Suitable exemplary supports are disclosed in *Product Licensing Index*, Vol. 92, December 1971, Publication 9232, at page 108, published by Industrial Opportunities Ltd, Homewell, Havant Hampshire, PO9 1EF United Kingdom. The support can incorporate one or more subbing layers for the purpose of altering its surface properties so as to enhance the adhesion of the radiation-sensitive coating to the support. A typical example of a subbing material is the terpolymer of vinylidene chloride, acrylonitrile, and vinyl chloride.

With regard to the matrix or binder of the element, although most of the embodiments hereinafter decribed use a polysulfonamide binder, other binders compatible with the cyclopropenone vesiculating agent and its solvent can also be used. For example, it is contemplated that the binder can be selected also from poly(vinyl chloride), poly(vinylidene chloride), and polystyrene; and copolymers obtained by copolymerizing acrylonitrile with vinyl chloride, styrene, vinylidene chlorofluoride, or 1,1-difluoroethylene; by copolymerizing vinyl chloride with methyl acrylate, acrylic acid, diethyl maleate, or vinyl acetate; or by copolymerizing vinylidene chloride with vinyl chloride, vinyl acetate, vinyl alcohol, ethyl acrylate, or acrylonitrile. Examples of the homo- or co-polymerization of vinylidene chloride are described in U.S. Pat. No. 3,032,414 issued to R. James. Still other examples include $\alpha$-chloroacrylonitrile preferably mixed with other copolymers, as disclosed for example in U.S. Pat. No. 3,620,743, and Bisphenol A/epichlorohydrin copolymer. As used herein, "Bisphenol A" means 4,4'-isopropylidene diphenol, sometimes known as 2,2-(p-hydroxyphenyl)propane.

With regard to the polysulfonamide binder, these are described as to composition and method of preparation in Research Disclosure, Vol. 131, Publication No. 13107, March 1975, published by Industrial Opportunities Ltd., the details of this Disclosure being expressly incorporated herein by reference. Generally, such polymeric binders have the group $>N\text{-}SO_2\text{-}$ as a portion of the polymer backbone or as a pendant moiety so as to possess the proper permeability constant for vesicular imaging and also to produce enhanced responsiveness in vesicular photographic elements. Thus it has been found that any sulfonamide polymer of this type is suitable, provided that the wavelength of maximum absorption of the binder, $\lambda_{max}$, is no greater than about 350 nm in the spectral range of 200 to 750 nm and preferably lower than 300 nm. It has been determined that higher values of $\lambda_{max}$ tend to produce colored binders which interfere with the absorption of light that is necessary to decompose the vesiculating agent. Particularly useful classes of such polymers include polymers containing toluene-2,4-disulfonamide units and those containing N-(vinylphenyl)-sulfonamide units. The binders of this class can be homopolymers, copolymers, or physical mixtures of the same. Whether the polymer is an addition polymer or a condensation polymer, a certain portion of the polymer should be recurring sulfonamide groups so that the weight percent of sulfur is at least about 4%.

Another useful class of such polysulfonamide binders includes the class having the general formula:

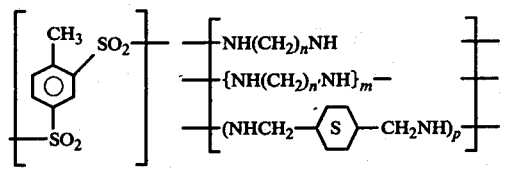

where n and n' are the same or different and are each a positive integer from 2 to 12; m is 0 or 1; and p is 0 when m is 1, and is 1 when m is 0.

With respect to the above-described binders, these satisfy the gas impermeability requirement for vesiculating elements wherein the imaging layer must be sufficiently impermeable to the decomposition gas formed upon exposure to retain it long enough to form the imaging vesicles upon heating. A conventional method for describing such gas impermeability has been to use the above-noted permeability constant described in U.S. Pat. No. 3,032,414. Such permeability constant has been required to fall within the range of about $1 \times 10^{-11}$ to about $1 \times 10^{-15}$. Because this constant is relatively difficult to measure, the following alternate test can be useful to ascertain that the necessary permeability constant, and therefore gas impermeability, is present in the binder of choice: The latent image stability period of the element is determined and compared against a standard. As used herein, "latent image stability period" is the length of time the latent vesicles, generated by the exposure steps described hereafter, and necessary to form an image during development, require to diffuse out of the element when stored at 22° C. to the point that no image greater than a density of 0.2 is developable. A useful test for making this determination comprises subjecting a candidate element, when fully manufactured as described below with a dry thickness of 10 to 15 microns, to the steps of:

(a) exposing the element for 36 seconds at ambient temperature, through a carbon step wedge to an undoped mercury arc lamp at a distance of about 7.6 cm, (b) storing the exposed element at 22° C. for various periods of time, and (c) then contacting the stored element with an aluminum block at 150° C. for 2 seconds to ascertain whether a developable image is left. The storage time necessary to produce no developable image of a density greater than 0.2 is the latent image stability period. It has been found that elements which produce satisfactory vesicular images are those in which the latent image stability period of the binder for CO is substantially greater than about one minute when coated in an element having a dried binder thickness found to be about 10 to about 15 microns. Highly preferred are those binders in which the gas impermeability for CO, under the test conditions noted, is such that the latent image stability period is equal to or greater than about 5 minutes. Specifically, it has been found that, using the above-described test, the latent image stability period for CO in poly(ethylene-co-1,4-cyclohexylenedimethylene-1-methyl-2,4-benzenedisulfonamide), one of the preferred binders of the element of this invention, is 44 minutes. For Bisphenol A/epichlorohydrin, it is about 9 minutes. This compares with an essentially zero latent image stability period that was found when the same test was run using cellulose acetate butyrate, a polymer unsuited for vesicular imaging.

The elements used to test the latent image stability period were prepared as follows:

Polymer solutions were prepared by separately dissolving 1.470 gm of cellulose acetate butyrate, Bisphenol A epichlorohydrin copolymer "epanol resin 55-B-40" sold by Shell Chemical Corp., and poly(ethylene-co-1,4-cyclohexylenedimethylene-1-methyl-2,4-benzenedisulfonamide) in 9.900 gm of solvent. The solvent was composed of equal weights of acetone and 2-methoxy ethanol. In each case a brilliant clear solution resulted by stirring at room temperature. An amount of 0.163 gm of 1-phenyl-2-anisyl cyclopropenone was added as a vesiculating agent to each solution. A clear solution resulted by stirring in each case. The polymer solutions were each coated using a 7 mil doctor blade on clear poly(ethytineterephthalate) support. The coatings were then each dried on the coating block for 5 minutes at 24° C., 5 minutes at 43° C. and by flash drying for 10 seconds at 150° C. on a heated aluminum drying block. The photographic elements formed as described were dry except for traces of residual solvent, and were about 10 to 13 microns thick. The dry laydown was 12 to 15 g per square meter.

It will be further appreciated that other factors can alter slightly the actual numerical values of the stability period. Included here, at least for polymers having polar sites, is the amount of residual solvent present in the polymer. Larger latent image stability periods will result if the dried binder thickness is greater.

Cyclopropenones

With respect to the novel vesiculating agent, it has been found that cyclopropenones comprise a class of agents which provide outstanding vesiculating characteristics, including improved thermal stability and the ability to be spectrally sensitized. To avoid the formation of colored cyclopropenones that affect the background of the image, $\lambda_{max}$ of such cyclopropenones, measured in ethanol between the spectral range of about 250 to about 650 nm, should be no greater than about 400 nm, where $\lambda_{max}$ is defined to mean the wavelength of maximum absorption of the compound.

Highly preferred are the vesiculating agents having the formula:

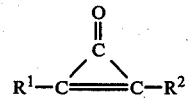

wherein:

$R^1$ and $R^2$ are the same or different and are each a substituted or unsubstituted aryl radical containing from 6 to 10 carbon atoms in the aromatic ring, such as, for example, phenyl and naphthyl; or an aralkenyl radical having 6 to 10 carbon atoms in the aryl portion and 1 to 5 carbon atoms in the alkenyl portion, for example 2,2-diphenylvinyl, 2-phenylvinyl, 2-naphthylvinyl and the like;

the substituents of each of the substituted aryl radical being one or more radicals selected from the group consisting of, in any position on the aryl ring:

(1) alkyl or alkoxy radicals containing from 1 to 5 carbon atoms, for example, methyl, ethyl, propyl, iso-propyl, butyl, methoxy, ethoxy, propoxy, butoxy and the like;

(2) a nitro radical;

(3) an aryloxy radical containing from 6 to 10 carbon atoms, for example phenoxy and naphthoxy and the like;

(4) a halogen, for example chlorine, fluorine and the like; and (5) a homopolymer or copolymer to which the aryl radical is attached as a dependent moiety, the polymer having at least one repeating unit with the formula

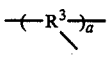

wherein $R^3$ is a lower alkylene radical containing from 1 to 5 carbon atoms, for example ethylene, propylene, and the like, and "a" is at least a portion of the number of repeating units in a given polymer chain.

Thus, $R^1$ and $R^2$ can each be any one of the following formulas:

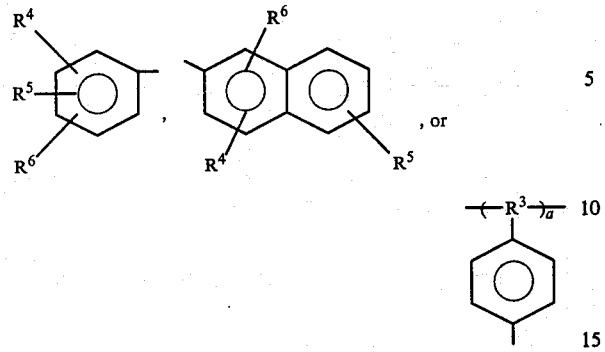

where $R^4$, $R^5$, and $R^6$ are the same or different and are any of the substituents defined above as (1), (2), (3) or (4), and $R^3$ is the repeating unit defined above as (5).

The following representative cyclopropenones are useful vesiculating agents according to the invention. The $\lambda_{max}$ for these agents was determined by measuring ultraviolet absorption peaks for each cyclopropenone in a Beckman model DB spectrophotometer, after dissolving the polymer in spectrographic grade ethanol, and by visually examining the cyclopropenone coating to ascertain that no significant absorption occurs in the visible spectrum, i.e., in the range 400 nm to 750 nm. The 400 nm limit on the value of $\lambda_{max}$ for the cyclopropenones is preferred to avoid undue coloration in the background.

The units set forth for cyclopropenone No. 8 are recurring units of the polymer.

Cyclopropenone No. 1

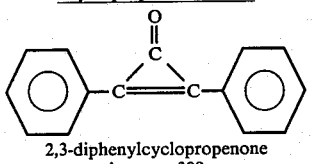

2,3-diphenylcyclopropenone
$\lambda_{max}$ = 300

Cyclopropenone No. 2

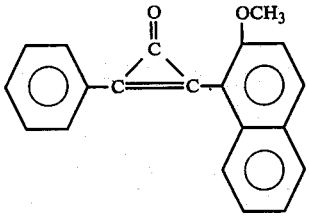

2-(2-methoxynaphthyl)-3-phenylcyclopropenone
$\lambda_{max}$ = 371

Cyclopropenone No. 3

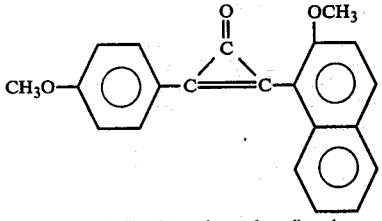

2-(2-methoxynaphthyl)-3-(4-methoxyphenyl)cyclopropenone
$\lambda_{max}$ = 372

Cyclopropenone No. 4

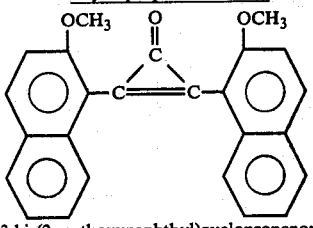

2,3-bis(2-methoxynaphthyl)cyclopropenone
$\lambda_{max}$ = 390

Cyclopropenone No. 5

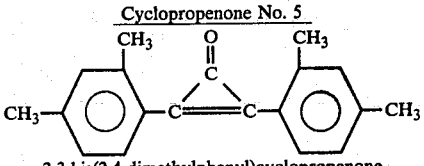

2,3-bis(2,4-dimethylphenyl)cyclopropenone
$\lambda_{max}$ = 325

Cyclopropenone No. 6

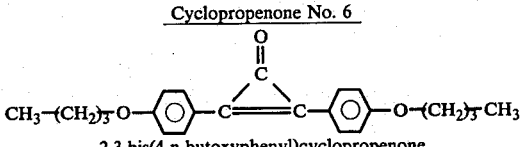

2,3-bis(4-n-butoxyphenyl)cyclopropenone
$\lambda_{max}$ = 328

Cyclopropenone No. 7

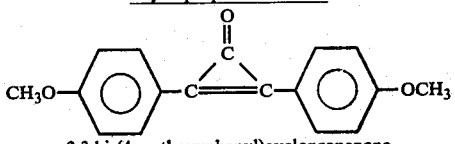

2,3-bis(4-methoxyphenyl)cyclopropenone
$\lambda_{max}$ = 323

Cyclopropenone No. 8

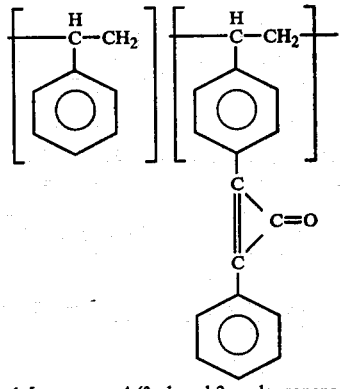

poly[styrene-co-4-(3-phenyl-2-cyclopropene-3-one-2-yl)styrene]
$\lambda_{max}$ = 305

Cyclopropenone No. 9

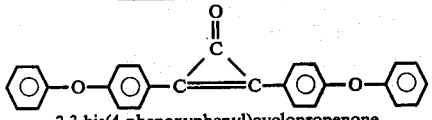

2,3-bis(4-phenoxyphenyl)cyclopropenone
$\lambda_{max}$ = 326

Cyclopropenone No. 10

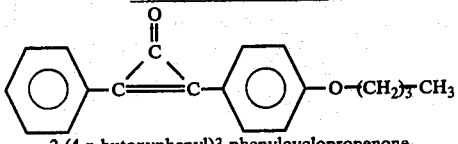

2-(4-n-butoxyphenyl)3-phenylcyclopropenone
$\lambda_{max}$ = 318

-continued

Cyclopropenone No. 11

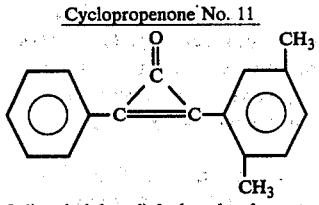

2-(2,5-dimethylphenyl)-3-phenylcyclopropenone
$\lambda_{max}$ = 302

Cyclopropenone No. 12

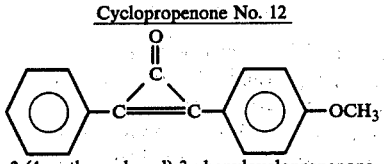

2-(4-methoxyphenyl)-3-phenylcyclopropenone
$\lambda_{max}$ = 313

Cyclopropenone No. 13

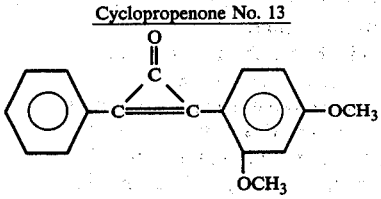

2-(2,4-dimethoxyphenyl)-3-phenylcyclopropenone
$\lambda_{max}$ = 342

Cyclopropenone No. 14

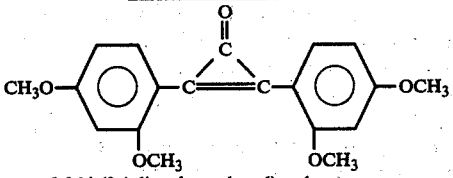

2,3-bis(2,4-dimethoxyphenyl)cyclopropenone
$\lambda_{max}$ = 350

Cyclopropenone No. 15

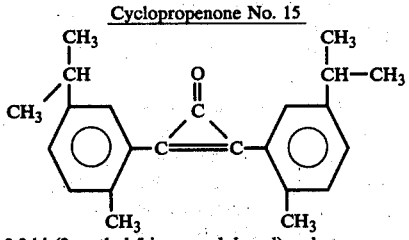

2,3-bis(2-methyl-5-isopropylphenyl)cyclopropenone
$\lambda_{max}$ = 300

Cyclopropenone No. 16

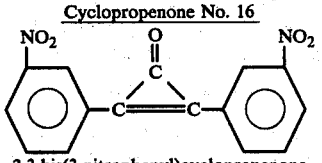

2,3-bis(3-nitrophenyl)cyclopropenone
$\lambda_{max}$ = 297

Cyclopropenone No. 17

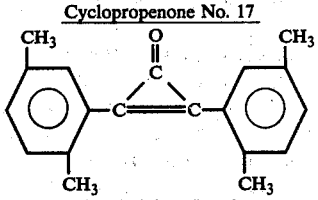

2,3-bis(2,5-dimethylphenyl)cyclopropenone
$\lambda_{max}$ = 325

Cyclopropenone No. 18

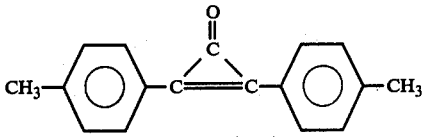

2,3-bis(4-methylphenyl)cyclopropenone
$\lambda_{max}$ = 310

Cyclopropenone No. 19

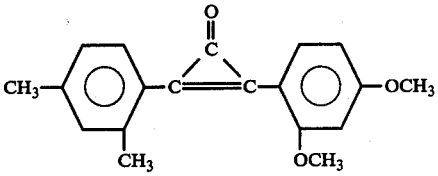

2-(2,4-dimethoxyphenyl)-3-(2,4-dimethylphenyl)cyclopropenone
$\lambda_{max}$ = 337

Cyclopropenone No.20

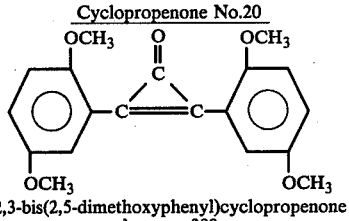

2,3-bis(2,5-dimethoxyphenyl)cyclopropenone
$\lambda_{max}$ = 380

Cyclopropenone No. 21

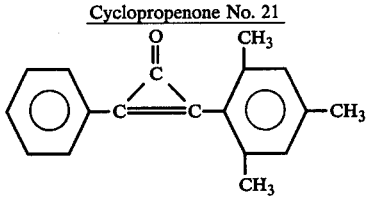

2-(2,4,6-trimethylphenyl)-3-phenylcyclopropenone
$\lambda_{max}$ = 285

Cyclopropenone No. 22

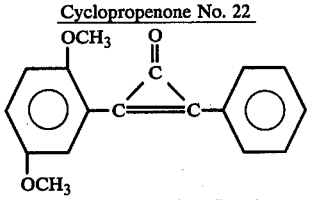

2-phenyl-3-(2,5-dimethoxyphenyl)cyclopropenone
$\lambda_{max}$ = 366

Cyclopropenone No. 23

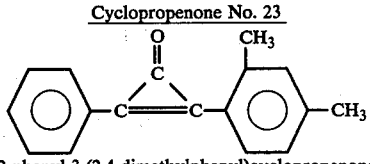

2-phenyl-3-(2,4-dimethylphenyl)cyclopropenone
$\lambda_{max}$ = 310

Cyclopropenone No. 24

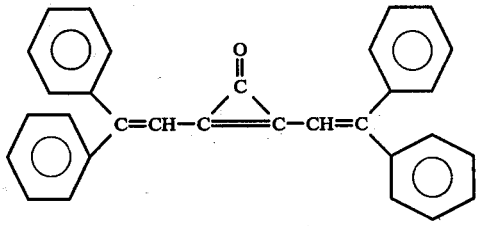

2,3-bis(2,2-diphenylvinyl)cyclopropenone
$\lambda_{max}$ = 374

The above cyclopropenones can be prepared by known processes, of which the following preparation of Cyclopropenone No. 2 is illustrative only:

A mixture of 14.0 g (0.11 mole) of anhydrous aluminum chloride and 17.8 g (0.10 mole) of tetrachlorocyclopropene in 200 ml of 1,2-dichloroethane is stirred at room temperature for one hour. The mixture is cooled to 0° C. and treated with 7.8 g (0.10 mole) of benzene, maintaining the temperature between 0° and 5° C. Upon completion of the addition, the reaction mixture is warmed slowly to 50° C., re-cooled to −25° C., and treated with a solution of 15.8 g (0.10 mole) of 2-methoxynaphthalene in 1,2-dichloroethane, maintaining the temperature between −25° and −20° C. Upon completion of the addition, the reaction mixture is allowed to warm to room temperature, and treated with ice and ice-water. The organic layer is separated, stripped in vacuo, and the resulting residue recrystallized from methanol to furnish 17.5 g of product, 2-(2-methoxynaphthyl)-3-phenylcyclopropenone.

The preparation of cyclopropenone No. 8 can be achieved as follows:

Trichlorocyclopropenium chloridoaluminate was prepared by reacting equimolar amounts of tetrachlorocyclopropene and aluminum chloride in 1,2-dichloroethane solution. A convenient mole proportion of trichlorocyclopropenium chloridoaluminate suspended in the 1,2-dichloroethane was cooled to 0° C. One equivalent weight of benzene was added slowly to the suspension while the mixture was stirred. The mixture was allowed to warm up slowly from 0° C. to ambient temperature to complete the reaction. A five percent solution of the polystyrene was prepared in a second reaction vessel by dissolving two mole equivalents based on styrene in 1,2-dichloroethane. One mole equivalent of the cyclopropenium ion, in suspension, was added slowly to the polystyrene solution. The resulting mixture was stirred at room temperature for one hour to complete the reaction.

The complexes resulting from the reaction were decomposed by adding a small amount of methanol to the 1,2-dichloroethane suspension followed by excess water at 5° C. The resulting emulsion was poured into an excess amount of methanol and the suspension agitated at high speed in a Waring Blender. The product remained suspended in the methanol while the impurities dissolved in the methanol. The fibrous solid product was obtained by filtering the suspension and washing the solid with methanol. The white colored product was dried under vacuum to remove the volatiles.

Spectral Sensitization

One advantage of a cyclopropenone vesiculating agent is that it can be spectrally sensitized by the addition of certain compounds. "Spectral sensitization" as used herein means the process by which the spectral sensitivity of the element is extended beyond the region of the electromagnetic spectrum to which the vesiculating agent is itself responsive. Preferred spectral sensitizers are separate compounds, having the above capability, which are not an integral moiety of the vesiculating agent prior to use.

As used in this application, the "limit of spectral sensitivity" means the maximum wavelength of exposure that would still produce in the element a density above fog, this wavelength sometimes being called the "cutoff absorbance".

Particularly useful spectral sensitizers with the vesiculating agents described above are those which have a $\lambda_{max}$ in methanol which is less than about 450 nm. While this limitation is not completely understood from a mechanistic point of view, it is likely that $\lambda_{max}$ greater than 450 nm tends to interfere with the energy transfer mechanism which permits the sensitization of the cyclopropenone.

In selecting a spectral sensitizer, it has been found that a convenient test to determine which will perform satisfactorily is as follows:

Test Procedure

An amount of 0.047 moles of the candidate is codissolved with a disulfonamide polymer, such as 3/4 g of poly(ethylene-co-1,4-cyclohexylenedimethylene-1-methyl-2,4-benzene disulfonamide) with an image-generating amount of any cyclopropenone disclosed herein in a suitable solvent, such as in 1.25 g acetone, 2.75 g methoxyethanol and 0.25 g N,N-dimethylformamide. Only that amount of cyclopropenone need be included which is sufficient to generate an image upon exposure to activating radiation. The composition is coated on a suitable support, such as poly(ethylene terephthalate) and dried to remove all but residual solvent, and the dried coating is exposed to a wedge spectrograph incorporating a B & L half meter monochrometer and a 900 watt Xenon arc. The spectral response of the composition as developed after exposure to the wedge spectrograph is examined at wavelengths considerably longer than the limit of spectral sensitivity of the cyclopropenone but still in the absorbence region of the sensitizer candidate. If an image response is obtained at these wavelengths, then spectral sensitization has occurred.

Following the above test, it has been found that 2-benzoylmethylene-3-methylnaphtho-(2,1-d)thiazoline (hereinafter "BNTZ"), 3-carboxymethyl-5-(3-ethylbenzothiazolinylidene) rhodanine, anhydro-3,3'-disulfopropyl-5-methoxythiacyanine hydroxide, 2-[bis(2-furoyl)-methylene]-1-methylnaphtho[1,2-d] thiazoline, and 3-benzoyl-7-methoxycoumarin particularly demonstrate a high degree of extended spectral sensitivity. Each of the above compounds has a $\lambda_{max}$ in methanol which is less than about 450 nm. For example, $\lambda_{max}$ of BNTZ is 410 nm. Although $\lambda_{max}$ of anhydro-3,3'-disulfopropyl-5-methoxythiacyanine hydroxide is 437 nm, it also absorbs beyond 450 nm. Combinations of spectral sensitizers can be used if desired.

Because of the above-described spectral sensitizers, the spectral sensitivity of the preferred cyclopropenone vesiculators can be extended to almost 500 nm.

Imaging Element

A useful embodiment of the invention is a vesicular imaging element prepared from the above cyclopropenone vesiculating agents by coating a layer of a solution comprising the binder, vesiculating agent and other desired addenda such as the spectral sensitizer, using coating techniques known in the photographic art. If the binder is not self-supporting, the coating is applied to a support. The support is preferably treated prior to coating with a conventional subbing material such as a terpolymer of vinylidene chloride, acrylonitrile and vinyl chloride. Suitable solvents for the coating include mixtures of ethanol, methanol, acetone, methoxyethanol, dimethylformamide, cyclohexanone, chloroform, dichloromethane, trichloroethane, and the like. These solvents are also suitable for the spectral sensitizers described above.

The binder concentration in the solution can be between about 2 and about 20% by weight. The concentration of cyclopropenone should be between about 10 and about 25% of the weight of the binder, and the concentration of sensitizer between about 0.05 and about 1.5% of the binder weight. Total solids content of the element is preferably between about 2.0 and about 6.5 g/m$^2$ of coating. Typically, the solution is coated onto the support, if used, by such means as whirler coating, brushing doctor-blade coating, hopper coating and the like. Thereafter, the solvent is evaporated. Other exemplary coating procedures are set forth in the *Product Licensing Index,* Vol. 92, December 1971, publication 9232, at p. 109, published by Industrial Opportunities Ltd., as noted above, and include melts which are extruded to form the film.

Coating aids can be incorporated into the coating composition to facilitate coating as disclosed on p. 108 of the above *Product Licensing Index* publication. It is also possible to incorporate antistatic layers and/or matting agents as described in the above *Product Licensing Index* publication. Plasticizers can be incorporated to modify the coatability or flexibility of the binder, if desired. Increased speed can be achieved by certain conventional addenda, at least some of which function as prenucleating agents which form sites for the gas bubbles, insuring a finer grain pattern. Examples of such prenucleating agents include waxes such as are taught in U.S. Pat. No. 3,355,295 to Priest. Finely divided pigment having an index of refraction approximately equal to that of the binder also increases the speed, as does exposure to high humidity.

The prepared imaging element according to the invention can then be imagewise exposed to ultraviolet light or visible light containing a strong ultraviolet component, such as is obtained from mercury arc lamps to provide a developable latent image. Such exposure is believed to cause the cyclopropenone to decompose into

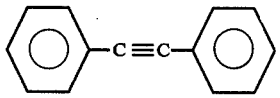

and carbon monoxide. Development is then achieved by heating the exposed element for a time and at a temperature sufficient to expand the CO gas within the exposed portion into vesicules. When the temperature of development is between about 100° C. and about 150° C., a few seconds of heating suffices.

If desired, the unexposed portion of the element thereafter can be conventionally flash-exposed and stored at a temperature and for a time sufficient to allow the predominant amount of the gas generated by said flash exposure to diffuse out of the element. Typically storage can be for several hours at a temperature below about 45° C.

The following examples further illustrate the invention.

EXAMPLE 1

An amount of 0.75 g of poly(ethylene-co-1,4-cyclohexylenedimethylene-1-methyl-2,4-benzene disulfonamide) binder, in which the ethylene and 1,4-cyclohexylendimethylene moieties were present on a 50/50 mole percent basis, was dissolved in 4.5 g of acetone/methoxyethanol mixed 50/50 by volume. The polymer had an inherent viscosity of 0.42 in dimethylformamide and a glass transition temperature (Tg) of 142° C. A clear solution was obtained by stirring and gentle heating. Two hundred milligrams of 2,3-diphenylcyclopropenone ($\lambda_{max}$ 300 nm) were added as a light-sensitive vesiculating agent. The clear lacquer solution was coated at 40° C. onto a 100 μm poly(ethylene terephthalate) film support at a wet thickness of 600 microns and dried at 57° C. to remove all but residual solvent.

A sample of the above element was exposed for 8 seconds to a 125 Watt undoped mercury arc lamp spaced about three inches from the film through a carbon wedge of 0.15 log E steps to provide a developable latent image in the element. The latent image was developed by heating the element on a heated block for three seconds at 128° C. An image was obtained that had a maximum specular density of 1.70.

EXAMPLE 1A

A sample of the element prepared as in Example 1 was nucleated by exposure to air at 38° C., 94% relative humidity for 10 minutes after which it was exposed and processed as described for Example 1. The film speed measured at D = 1.0 after exposure to high humidity, was increased by 0.45 log E. Thus, the photographic element as prepared in this example is spontaneously nucleated by exposure to high humidity.

EXAMPLE 2

As an illustration of the "Test Procedure" described above, an amount of three-quarters of a gram of poly(ethylene-co-1,4-cyclophexylenedimethylene-1-methyl-2,4-benzene disulfonamide), as described in Example 1, was dissolved in a mixture of 1.25 g acetone, 2.75 g methoxyethanol and 0.25 g N,N-dimethylformamide. A clear solution was obtained by heating gently (~30° C.) and stirring. Two hundred milligrams of 2,3-diphenylcyclopropenone was added as a light-sensitive vesiculating agent and 15 milligrams of the spectral sensitizer BNTZ, $\lambda_{max}$ = 410 nm, was added for spectral sensitizing.

A clear lacquer solution was obtained which was coated on poly(ethylene terephthalate) as described in Example 1. The coating, exposed on a wedge spectrograph, showed a sensitivity range extending to 480 nm as shown by curve 10 in FIG. 1, compared to only about 375 for the same element but without the spectral sensitizer, curve 12 in FIG. 1. Thus, there was demonstrated a spectral response at 410 nm that could only come from the sensitizer. Exposure of the element imagewise and development as described in Example 1 gave an image which had a maximum specular density of 2.10.

EXAMPLE 3

An amount of three-quarters of a gram of poly (ethylene-co-1,4-cyclohexylenedimethylene-1-methyl-2,4-benzene disulfonamide), as described in Example 1, was dissolved in a mixture of 2.75 g of methoxyethanol, 1.60 g of N,N-dimethylformamide and 1.25 g of acetone. A clear solution was obtained by gentle heating and stirring at 30° C. Two hundred milligrams of 2,3-diphenylcyclopropenone was added as a light-sensitive vesiculating agent, along with 15 mg of 3-carboxymethyl-5-(3-ethylbenzothiazolinylidene)rhodanine having $\lambda_{max}$ = 425 nm, added as a spectral sensitizer.

A clear lacquer solution was obtained which was coated on poly(ethylene terephthalate) support as described in Example 1. The coating exposed on a wedge spectrograph showed a sensitivity range extended to 480 nm. Again, spectral sensitivity in the terms of the "Test Procedure" was demonstrated. Exposure of the element imagewise and development as described in Example 1 gave an image which had a maximum specular density of 2.10.

EXAMPLE 4

An amount of three-quarters of a gram of poly (ethylene-co-1,4-cyclohexylenedimethylene-1-methyl-2,4-benzene disulfonamide) described in Example 1 was dissolved in 2.25 g of acetone and 2.25 g methoxyethanol. A clear solution resulted from gentle heating and stirring. Thirty-five milligrams of 2-(2-methoxynaphthyl)-3-phenylcyclopropenone was next dissolved in the polymer solution.

A clear lacquer solution was obtained by dissolving the vesiculator in the polymer which was coated on a poly (ethylene terephthalate) support, as described in Example 1. The vesicular element was exposed and processed as described in Example 1. An image was obtained that had a $D_{max}$ specular density of 2.10.

EXAMPLE 5

An amount of three-quarters of a gram of poly (ethylene-co-1,4-cyclohexylenedimethylene-1-methyl-2,4-benzene disulfonamide) as described in Example 1 were dissolved in 2.25 g of acetone and 2.25 g of methoxyethanol. A clear solution resulted. Thirty-five milligrams of the cyclopropenone of Example 4 was next dissolved in the polymer solution; along with 14 milligrams of anhydro-3,3'-disulfopropyl-5-methoxythiacyanine hydroxide, $\lambda_{max}$ = 380 nm, as the spectral sensitizer.

Figure 2:
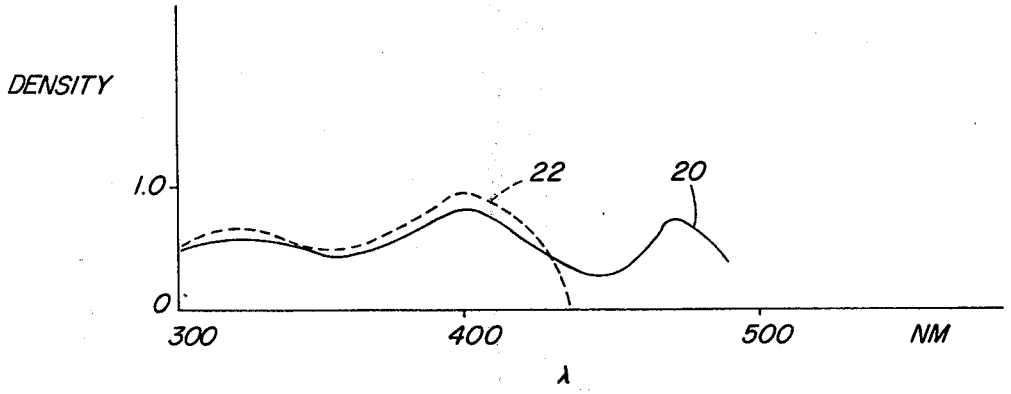

A clear lacquer solution was obtained which was coated on poly(ethylene terephthalate) support as described in Example 1. The coating, exposed on a wedge spectrograph, showed the sensitivity range extended to 480 nm, curve 20 of FIG. 2, compared to the value of about 425 nm, curve 22 of FIG. 2, achieved for the same element but without this spectral sensitizer. Enhanced spectral response, due to the sensitizer, is evident at 475 nm, a wavelength considerably longer than the limit of spectral sensitivity demonstrated by the cyclopropenone. Imagewise exposure of the element and processing as described in Example 1 gave an image which had a maximum specular density of 2.10.

EXAMPLE 6

An amount of three-quarters of a gram of poly(ethylene-co-1,4-cyclohexylenedimethylene-1-methyl-2,4-benzene disulfonamide) were dissolved in 2.25 g of acetone and 2.25 g of methoxyethanol. A clear solution resulted. Thirty-eight milligrams of vesiculating agent 2,3-bis(2-methoxynaphthyl cyclopropenone) were next dissolved in the polymer solution.

A clear lacquer solution was obtained which was coated on poly(ethylene terephthalate) support as described in Example 1. The vesicular element was exposed and processed as described in Example 1. An image was obtained that had a maximum specular density of 2.15.

EXAMPLE 7

An amount of three-quarters of a gram of poly (oxy-1,4-phenylene dimethylmethylene-1,4-phenylene,oxy-2-hydroxytrimethylene), a Bisphenol A/epichlorohydrin copolymer, was dissolved as the binder in 2.25 g of acetone and 2.25 g of methoxyethanol. A clear solution was obtained by gently heating and stirring at 30° C. An amount of three hundred milligrams of the vesiculating agent of Example 1 was added as a light-sensitive vesiculating agent along with 18 milligrams of the spectral sensitizer of Example 2.

A clear lacquer solution was obtained which was coated on a poly(ethylene terephthalate) support as described in Example 1. The coating was exposed on a wedge spectrograph which showed an extended sensitivity range to 480 nm. Imagewise exposure of the element and processing as described in Example 1 gave an image which had a maximum specular density of 2.10.

The invention has been described in detail with particular reference to certain preferred embodiments thereof, but it will be understood that variations and modifications can be effected within the spirit and scope of the invention.

What is claimed is:

1. In a vesicular imaging composition comprising: (I) a polymeric binder having sufficient gas impermeability as to provide a latent image stability period for CO that is substantially greater than about one minute when ascertained for an element having a dried binder thickness of between about 10 and about 15 microns; and (II) admixed with said binder, a radiation-decomposable vesiculating agent capable of generating a gas upon imagewise exposure;

the improvement wherein the vesiculating agent is a cyclopropenone having a $\lambda_{max}$ in ethanol no greater than about 400 nm in the spectral range of about 250 to about 650 nm.

2. A composition as defined in claim 1 wherein said cyclopropenone has the formula:

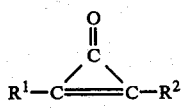

wherein:

$R^1$ and $R^2$ are the same or different, and are each a substituted or unsubstituted aryl radical containing from 6 to 10 carbon atoms in the aromatic ring, or an aralkenyl radical having 6 to 10 carbon atoms in the aryl portion and 1 to 5 carbon atoms in the alkenyl portion;

the substituents of each of said substituted aryl radical being one or more radicals selected from the group consisting of:

(1) alkyl or alkoxy containing from 1 to 5 carbon atoms;
(2) nitro;
(3) aryloxy containing from 6 to 10 carbon atoms;
(4) halogen; and
(5) a polymer to which the aryl radical is attached as a dependent moiety, the polymer having at least one repeating unit which is a lower alkylene containing from 1 to 5 carbon atoms.

3. A composition as defined in claim 2 wherein at least one of $R^1$ and $R^2$ is a bi-substituted aryl radical.

4. A composition as defined in claim 3 wherein said agent is 2-(4-methoxyphenyl)-3-phenylcyclopropenone.

5. A composition as defined in claim 1 wherein said agent is diphenylcyclopropenone.

6. A composition as defined in claim 1 and further including a spectral sensitizing compound having a $\lambda_{max}$ in methanol which is less than about 450 nm, said compound being one that, when co-dissolved with a sulfonamide polymer and an amount of said cyclopropenone effective to photogenerate an image, forms a composition which can be dried in a layer and which upon imagewise exposure demonstrates a spectral response at a wavelength that is (a) longer than the limit of the spectral sensitivity of the cyclopropenone and (b) still within the absorbence region of said compound.

7. A composition as defined in claim 6, wherein said compound is 2-benzoylmethylene-3-methylnaphtho(2,1-a) thiazoline.

8. A composition as defined in claim 6, wherein said compound is 3-carboxymethyl-5-(3-ethylbenzothiazolinylidene)rhodanine.

9. A composition as defined in claim 6, wherein said compound is anhydro-3,3'-disulfopropyl-5-methoxythiacyanine hydroxide.

10. A vesicular imaging element, comprising:

a support;

coated on the support, a water-insoluble, thermoplastic binder having a gas impermeability sufficient to provide a latent image stability period for CO that is substantially greater than about one minute when ascertained for an element having a dried binder thickness of between about 10 and about 15 microns;

as a vesiculating agent, a cyclopropenone admixed with said binder, having the formula:

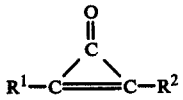

wherein:

$R^1$ and $R^2$ are the same or different, and are each a substituted or unsubstituted aryl radical containing from 6 to 10 carbon atoms in the aromatic ring, or an aralkenyl radical having 6 to 10 carbon atoms in the aryl portion and 1 to 5 carbon atoms in the alkenyl portion;

the substituents of each of said substituted aryl radical being one or more radicals selected from the group consisting of:

(1) alkyl or alkoxy containing from 1 to 5 carbon atoms;

(2) nitro;

(3) aryloxy containing from 6 to 10 carbon atoms;

(4) halogen; and (5) a polymer to which the aryl radical is attached as a dependent moiety, the polymer having at least one repeating unit which is a lower alkylene containing from 1 to 5 carbon atoms.

11. An element as defined in claim 10, and further including, in admixture with said binder, a spectral sensitizing compound having a $\lambda_{max}$ in methanol which is less than about 450 nm, said compound being one that, when co-dissolved with a sulfonamide polymer and an amount of said cyclopropenone effective to photogenerate an image, forms a composition which can be dried in a layer and which upon imagewise exposure demonstrates a spectral response at a wavelength that is (a) longer than the limit of the spectral sensitivity of the cyclopropenone and (b) still within absorbence region of said compound.

12. An element as defined in claim 11, wherein said spectral sensitizing compound is 2-benzoyl-methylene-3-methylnaphtho-(2,1-a)thiazoline.

13. A process for forming a photographic image, comprising the steps of:

(a) imagewise-exposing to activating radiation a radiation-sensitive photographic element containing an admixture of a polymeric binder and a decomposable radiation-sensitive cyclopropenone having a $\lambda_{max}$ in ethanol which is no greater than about 400 nm in the spectral range of about 250 to about 650 nm to form a developable latent image in said element, and (b) developing the resulting image by heating said element to a temperature and for a time sufficient to force CO bubbles formed by the photodecomposition of the agent to expand to form a visible image.

14. The process as defined in claim 13 wherein the cyclopropenone has the formula:

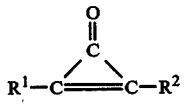

wherein:

$R^1$ and $R^2$ are the same or different, and are each a substituted or unsubstituted aryl radical containing from 6 to 10 carbon atoms in the aromatic ring, or an aralkenyl radical having 6 to 10 carbon atoms in the aryl portion and 1 to 5 carbon atoms in the alkenyl portion;

the substituents of said substituted aryl radical being selected from the group consisting of:

(1) alkyl or alkoxy containing from 1 to 5 carbon atoms;

(2) nitro;

(3) aryloxy containing from 6 to 10 carbon atoms;

(4) halogen; and (5) a polymer to which the aryl radical is attached as a dependent moiety, the polymer having at least one repeating unit which is a lower alkylene containing from 1 to 5 carbon atoms.

15. A process as defined in claim 13 wherein said heating is carried out at a temperature within the range of 100° C. to 150° C.

* * * * *